US005113308A

United States Patent [19]

Takeda

[11] Patent Number: 5,113,308

[45] Date of Patent: May 12, 1992

[54] ACTUATOR WITH A BUILT-IN REED SWITCH

[75] Inventor: Hideaki Takeda, Misato, Japan

[73] Assignee: Uchiya Thermostat Co., Misato, Japan

[21] Appl. No.: 575,891

[22] Filed: Aug. 31, 1990

[51] Int. Cl.[5] ..... H01H 47/04

[52] U.S. Cl. ..... 361/178; 361/187; 335/151

[58] Field of Search ..... 335/151-153, 335/251, 253, 255, 256, 266, 166, 173; 361/159-160, 170, 173, 178, 187; 307/116-118

[56] References Cited

U.S. PATENT DOCUMENTS

| | | | |
|---|---|---|---|
| 3,486,139 | 12/1969 | Armstrong et al. | 335/151 |
| 3,568,008 | 3/1971 | Tanimura et al. | 361/155 |
| 4,712,154 | 12/1987 | Modsen | 361/178 |

FOREIGN PATENT DOCUMENTS

3800291A1 7/1989 Fed. Rep. of Germany .

OTHER PUBLICATIONS

Wiley, C. W., "Home Appliances: Market for Solid State", Electronics, vol. 36, Sep. 13, pp. 14-15.

*Primary Examiner*—A. D. Pellinen
*Assistant Examiner*—Fritz Fleming
*Attorney, Agent, or Firm*—Stanger, Michaelson, Spivak & Wallace

[57] ABSTRACT

An actuator with a built-in reed switch includes a solenoid, a plunger made of magnetic material and movable within a coil of the solenoid, a plunger receiver made of magnetic material and fixedly mounted in the solenoid coil, a magnetic responsive reed switch connected in series to the solenoid coil and disposed near a gap between the plunger and the plunger receiver, and a sensor terminal branched from a junction between the solenoid coil and the reed switch, whereby contacts of the reed switch are closed by a magnetic field generated when a current flows through the sensor terminal in the solenoid coil. The actuator shifts from high sensitivity to lower sensitivity and supplies a sufficient driving force as an actuator.

3 Claims, 3 Drawing Sheets

ACTUATOR WITH A BUILT-IN REED SWITCH

FIELD OF THE INVENTION AND RELATED ART STATEMENT

The present invention relates to an actuator with a built-in reed switch.

An actuator provided with a relay including a movable element made of magnetic material disposed in a coil and operated by a magnetic field generated when a current flows through the coil and electrical contacts which is intermittent in response to the operation of the movable element or a solenoid valve including the movable element having the same structure and operation as those of the relay and a valve which is opened and closed in response to the operation of the movable element is widely used.

The electrical actuator represented by the solenoid uses a magnetic force generated by a current flowing through the coil as a attractive force. In order to adjust the attractive force to a proper value with respect to a load, the number of turns of the coil and a current value are important. When the product "A.T (ampere-turn)" is constant, the attractive force is identical. Accordingly, an optimum value thereof is selected on the basis of a voltage of a power source, a dimension of a coil, an attractive force and a temperature of heat generated at the coil. Generally, a large attractive force requires a large current value.

When a variation in a small current is detected to interrupt a large current, large force and high sensitivity are required. Presently, since the two can not be realized by a single device, an amplifier using a semiconductor is generally employed to operate an actuator having a large force or a device such as, for example, a reed relay having a large operation sensitivity is used for detection to thereby drive the actuator.

When a semiconductor circuit is used, there is a tendency that the number of parts containing a peripheral circuit such as a power circuit is increased and an occupancy volume is also increased. While many optional functions can be provided, it is difficult to reduce cost.

Further, the reed relay has a simple structure, although when a resistance for detection is made large to increase the sensitivity in setting of the sensitivity, a coil resistance of the reed relay itself can be increased. If trouble such as short-circuit in the detection side occurs, there is a possibility that power applied to the coil is excessive.

OBJECT AND SUMMARY OF THE INVENTION

It is an object of the present invention to provide a high sensitive actuator having a current sensitive function which is small in size and has a high sensitivity and a sufficient driving force as the actuator to thereby provide various small and inexpensive protection devices.

In order to solve the above problem, an actuator with a built-in reed switch according to the present invention comprises a plunger composed of a solenoid and a magnetic substance and movable within a solenoid coil, a plunger receiver made of magnetic substance and fixedly mounted within the solenoid coil, a magnetic responsive reed switch connected in series to the solenoid coil and disposed near a gap between the plunger and the plunger receiver, and a sensor terminal branched from a junction between the solenoid coil and the magnetic responsive reed switch, whereby contacts of the magnetic responsive reed switch are closed by a magnetic field generated when a current flows through the solenoid coil through the sensor terminal.

FIG. 6 shows an embodiment of an electric circuit in the case where a high sensitivity actuator according to the present invention is implemented as a power interrupting relay.

Operation of the present invention is described taking up this electric circuit as an example.

A power source is connected to terminals I1 and I2 and a load is connected to terminals O1 and O2. The terminals I1 and O1 are connected to each other through a contact P, while the terminals I2 and O2 are connected to each other through a contact Q. The contacts P and Q always connect between terminals a1 and a2 and terminals b1 and b2, respectively, and when a current flows through a coil, the contacts P and Q open between the terminals a1 and a2 and the terminals b1 and b2, respectively. The terminal a2 of the contact P on the load side thereof is connected to one end of the coil and the terminal b2 of the contact Q on the load side thereof is connected through a contact R to the other terminal of the coil. The contact R is a magnetic responsive reed switch disposed near a gap between a plunger and a plunger receiver to respond to magnetism with high sensitivity and which is conductive in response to the magnetism of the coil. Sensor terminals S1 and S2 are branched from terminals C1 and C2 on both sides of the contact R.

When a current does not flow through the coil, the reed switch does not respond to the magnetism and accordingly the contact is opened. Accordingly, the connection state of the contacts P and Q is maintained.

When the sensor terminals S1 and S2 are immersed in the water, a current obtained by dividing a voltage of the power source by a sum of an impedance of the coil and an impedance of the water flows through the coil. When the current flows through the coil, a stray magnetic field is produced in the gap between the plunger and the plunger receiver and the reed switch responds to this magnetic field to close the contact R, so that a current obtained by dividing the power voltage by an impedance of the coil flows through the coil. This means that the current flowing through the coil is increased. Consequently, the contacts P and Q are opened to cut off the power source.

When the voltage of the power source is 100 V, a resistance of the solenoid coil is 1000Ω, the number of turns of the coil is 10000 T, and a responsive value which is a minimum magnetic field value for operating the reed switch is 20 AT, a current for the coil at the time when the reed switch is operated is 20÷10000, that is, 2 mA. When the coil current is 2 mA in the case where a resistance between sensor electrodes is connected in series to the resistance 1000Ω of the coil, the whole resistance is 100 V/2 mA, that is, 50KΩ. This means that the reed switch is operated when the resistance between the sensor electrodes is 49KΩ.

When the reed switch is operated, a voltage of the power source having 100 V is directly applied to the coil of 1000Ω. At this time, a current of 100 mA flows through the coil and a magnetic field of 1000 AT is produced in the coil. That is, the magnetic field is magnified to 50 times. This value is improved by varying the sensitivity of the reed switch and the number of turns of the coil. However, there is a case where actual sensitivity is reduced as compared with a calculated value due to mechanical loss or the like.

In this manner, even when a current flowing through the coil C is very small and the contacts P and Q can be opened by the current, the reed switch responsive to a magnetism produced by the very small current is used to increase the current flowing through the coil C and open the contacts P and Q. That is, a large current type high sensitivity actuator can be realized.

Effects of the present invention is as follows:

1) A large current can be cut off by a very small current.
2) It can be used as a solenoid relay which detects a current in the immersion to interrupt the power source.
3) It can be used as a temperature switch which detects a variation of a current by a resistance corresponding to a temperature between detection electrodes to drive a solenoid.
4) It can be used as a humidity switch which detects a variation of a current by a resistance corresponding to a humidity between detection electrodes to drive a solenoid.
5) It can be used as a light amount switch in which a photosensor such as CdS is connected between detection electrodes and a solenoid is controlled in accordance with an amount of light.
6) It can be used as a thermal sensitive actuator in which a temperature sensor such as a thermistor of which a resistance is varied in accordance with a temperature is connected between detection electrodes and a valve or the like for liquid or gas is operated in accordance with a variation of temperature.
7) It can be used as a smoke sensitive actuator in which a photosensor such as CdS of which a resistance is varied in accordance with an amount of light is connected between detection electrodes to detect a variation of light amount by an amount of smoke and control a valve or the like for liquid or gas.
8) It can be used as a thermal sensitive electromagnetic valve in which a temperature sensor such as a thermistor or the like of which a resistance is varied in accordance with a temperature is connected between detection electrodes to control a valve for liquid or gas in accordance with a temperature.

DETAILED DESCRIPTION OF THE PREFERRED EMBODIMENTS

A preferred embodiment of a high sensitivity actuator according to the present invention is shown in FIGS. 1 to 5.

Input terminals I1 and I2 connected to a power source are connected through stationary contact a1 and movable contact a2, a stationary contact b1, a movable contact b2 and conductors L1 and L2 to output terminals O1 and O2 connected to a load, respectively.

The movable contacts a2 and b2 are provided on end portions of movable plates E1 and E2 having the resilience and projections K1 and K2 of the movable plates E1 and E2 press a moving element M by the resilience.

The moving element M includes a narrow portion m1 and a wide portion m2. When the moving element M is moved and the narrow portion m1 abuts against the projections K1 and K2, the contacts a1 and a2 and the contacts b1 and b2 are closed, while when the wide portion m2 abuts against the projections K1 and K2, the contacts a1 and a2 and the contacts b1 and b2 are opened.

Figure 5:
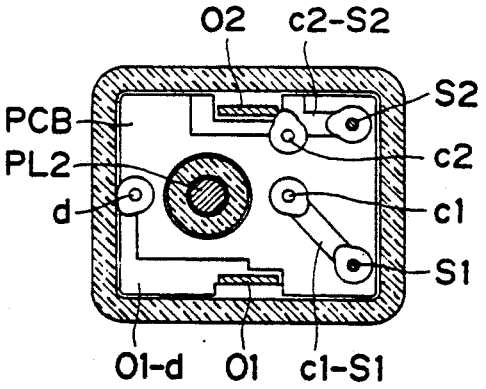
FIG. 5 is a sectional view taken along line 5—5 of FIG. 1.
Figure 6:
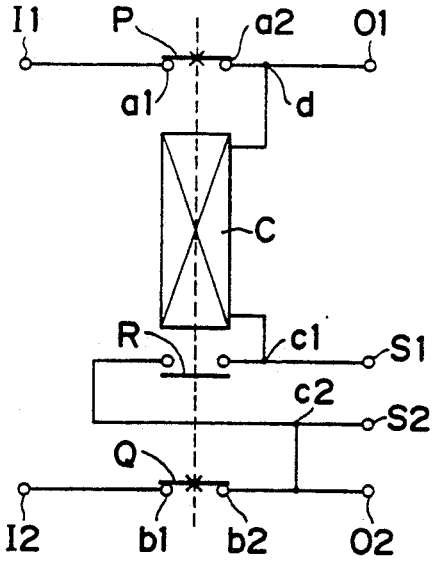
FIG. 6 is an electrical circuit diagram in the case where the high sensitivity actuator according to the present invention is implemented as a power interrupter relay.

As shown in FIG. 5, one output terminal O1 is connected through a conductor O1-d on a printed circuit board PCB to one terminal d of a solenoid coil C. The other terminal c1 of the solenoid coil C is connected through a conductor c1-S1 on the printed circuit board PCB to one sensor terminal S1. The sensor terminal S1 is further connected to one terminal of a reed switch R. The other terminal c2 of the reed switch R is connected through a conductor c2-S2 on the printed circuit board PCB to the other sensor terminal S2 and the other output terminal O2.

The solenoid coil C is wound on a coil bobbin B and when a current flows through the coil C, a magnetic field is produced within the coil bobbin B. A plunger PL1 and a plunger receiver PL2 formed of magnetic material are disposed in the coil bobbin B and the plunger receiver PL2 is urged to be moved in the opposite direction to the plunger PL1 by a spring SP. There is a gap GAP between the plunger PL1 and the plunger receiver PL2 and when a predetermined current flows through the coil C, the plunger PL1 can be moved in the direction of the plunger receiver.

The plunger PL1 and the moving element M are coupled with each other. Accordingly, when the plunger PL1 is moved toward the plunger receiver PL2, the moving element M is also moved and the wide portion m2 of the moving element M abuts against the projections K1 and K2 to open the contacts a1 and a2 and the contacts b1 and b2.

Even if a current flows through the solenoid coil, when the current is very small and does not reach a predetermined value, the plunger PL1 is not moved. However, at this time, a stray magnetic field is generated in the gap GAP between the plunger PL1 and the plunger receiver PL2. In order to dectect the leakage magnetic field, the reed switch R is disposed so that the contacts of the reed switch R are positioned near the gap GAP between the plunger PL1 and the plunger receiver PL2. Since the contacts of the reed switch R are disposed near the gap, the reed switch R can detect the stray magnetic field by a current which does not reach the predetermined value for moving the plunger PL1 and the reed switch R is closed at this time.

Consequently, both ends of the solenoid coil C are directly connected to the power source. Accordingly, the predetermined current flows through the solenoid coil and the plunger PL1 is attracted toward the plunger receiver PL2 so that the moving element M is also moved to open the contacts a1 and a2 and the contacts b1 and b2 and interrupt the power source.

Figure 1:
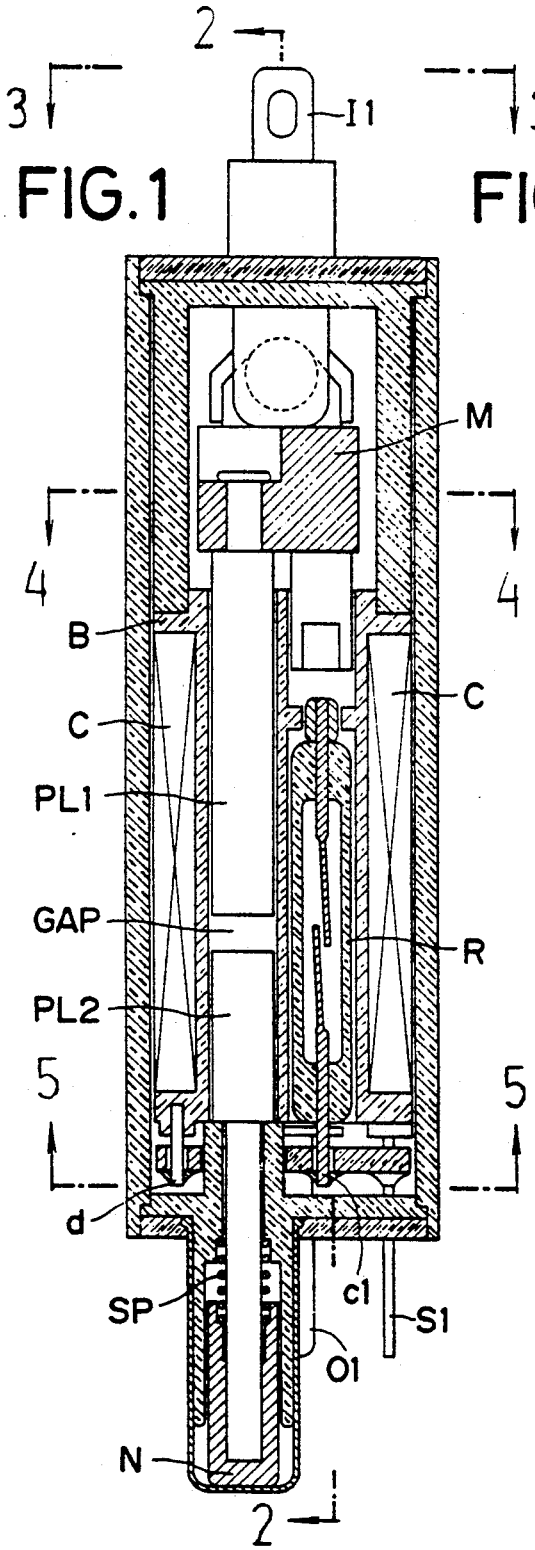
FIG. 1 is a sectional view of a preferred embodiment of a high sensitivity actuator according to the present invention.
Figure 2:
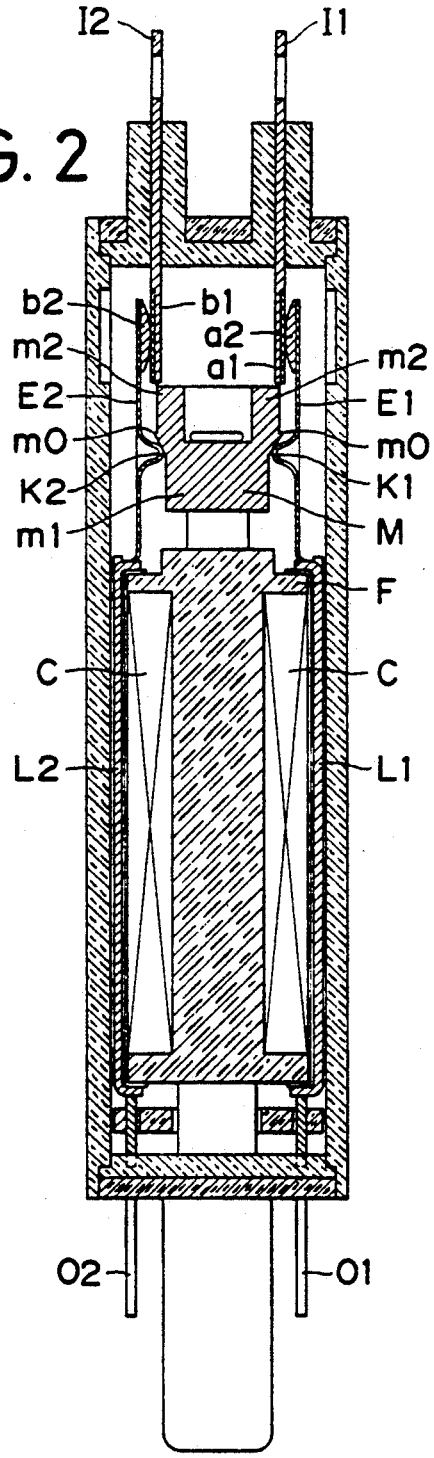
FIG. 2 is a sectional view taken along line 2—2 of FIG. 1.
Figure 3:
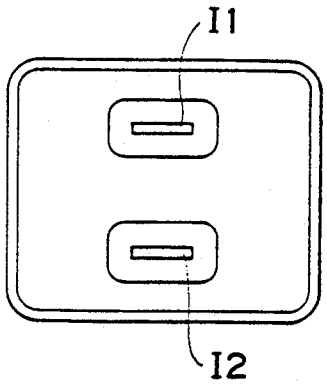
FIG. 3 is a top view of FIG. 1.
Figure 4:
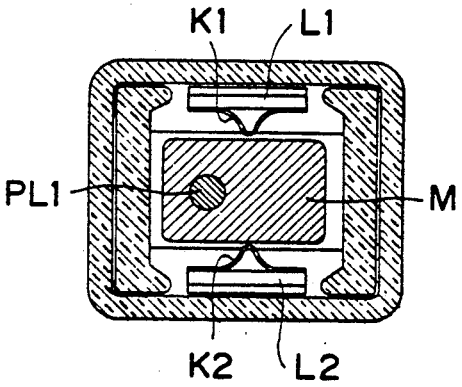
FIG. 4 is a sectional view taken along line 4—4 of FIG. 1.

When the power source is interrupted, force exerted on the plunger PL1 is removed and accordingly this state is maintained. In order to maintain this state forcedly, as shown in FIG. 2, a protrusion m0 is provided between the narrow portion m1 and the wide portion m2 of the moving element M. Thus, the protrusion m0 is engaged with the projections K1 and K2 of the springs E1 and E2 to prevent the movement of the moving element.

The plunger receiver PL2 is always urged to be moved outwardly by the spring SP, although the plunger receiver PL2 can be moved inwardly by pressing a reset button M inwardly. When the reset button N is pressed inwardly in the case where the plunger PL1 is moved toward the plunger receiver PL2 and is in contact with the plunger receiver PL2, the plunger PL1 is pressed by the plunger receiver PL2 and is moved inwardly. Consequently, the moving element M is also moved and the narrow portion m1 of the moving element abuts against the projections K1 and K2 so that the terminals a1 and a2 and the terminals b1 and b2 are closed and the input terminals I1 and I2 and the output terminals O1 and O2 are electrically connected.

The reset button is covered by a cover made of flexible synthetic resin and the whole actuator is also covered in the waterproof manner by a casing made of insulative material except the input terminals I1 and I2, the output terminals O1 and O2, and the sensor terminals S1 and S2.

When the plunger is attracted and the gap GAP between the plunger and the plunger receiver is reduced to zero, the magnetic field between the contacts of the reed switch is weakened or reduced to zero and the reed switch is turned off (opened). Accordingly, the current flowing through the solenoid coil is returned to the original value. When the factor for operating the reed switch by operating the solenoid is removed, the current is further decreased. That is a momentary operation in which only a momentary current flows through the solenoid. In this manner, since any current for holding the operation is not required, the coil is not heated and the operation is stable and has less energy consumption.

Figure 7:
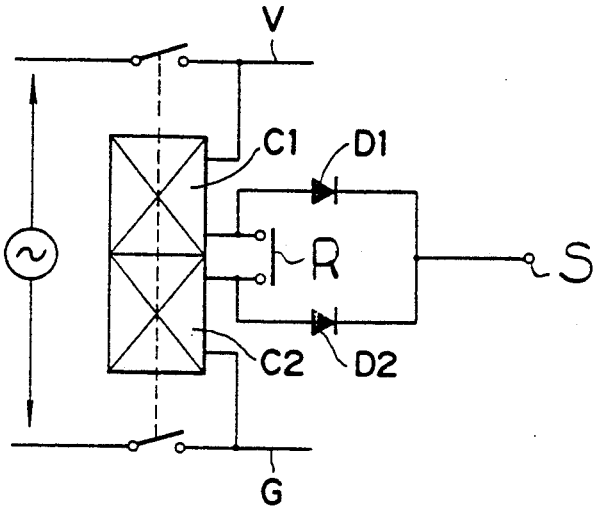
FIGS. 7 and 8 are circuit diagrams of modifications of the present invention.

FIG. 7 is a circuit diagram of a modification of the present invention.

A solenoid coil is composed of two coils C1 and C2 connected in series. Both the coils are connected through a reed switch R. The reed switch is disposed near the gap between the plunger and the plunger receiver in the same manner as FIG. 1. Both ends of the reed switch R are connected to anodes of diodes D1 and D2. Cathodes of the diodes D1 and D2 are connected to each other and further connected to the sensor terminal S.

No current flows through the coil in a waiting state. However, when a resistance between the sensor terminal S and a ground line G or a power line V is reduced (for example, when water enters and an insulation is reduced), a half-wave current flows through the coil. When the reed switch R detects a leakage magnetic field by the half-wave current and the reed switch is conductive, a voltage of the power source is directly applied to the solenoid coil. In this case, the circuit is characterized in that even if the resistance between the sensor electrode S and the ground line is reduced and even if the resistance between the sensor electrode S and the power line is reduced, the circuit is operated.

The disposition of the anode and the cathode of the diode can be reversed.

Figure 8:
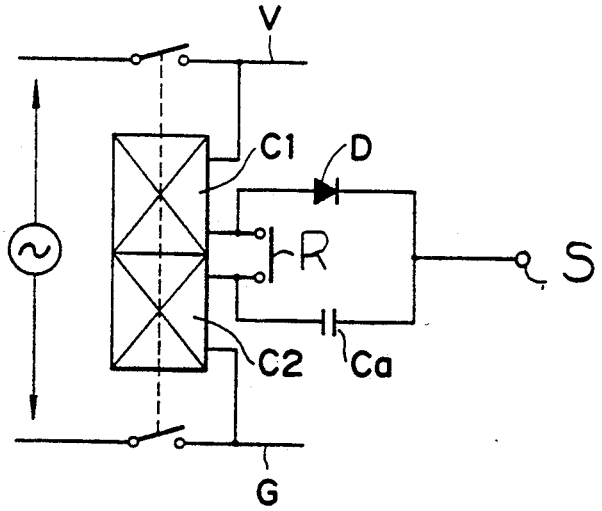

FIG. 8 is a circuit diagram of another modification of the present invention.

The coil is also composed of two series-connected coils C1 and C2 and both the coils C1 and C2 are connected through the reed switch R, which is disposed near the gap between the plunger and the plunger receiver.

One end of the reed switch R is connected to an anode of the diode D and the other end of the reed switch is connected to one end of the condenser Ca. The cathode of the diode D and the other end of the condenser Ca are connected to each other and further connected to the sensor terminal S.

No current flows through the coil in the waiting state. However, when a resistance between the sensor terminal S and the ground line G or the power line V is reduced, a current begins to flow through the diode or the condenser. Consequently, in the same manner as FIG. 1 or FIG. 7, the reed switch detects the stray magnetic field and is conductive.

In this case, a single sensor terminal is sufficient and accordingly mounting is easy.

I claim:

1. An actuator with a built-in reed switch comprising a solenoid having a coil, a plunger made of magnetic material and movable within the coil of said solenoid, a plunger receiver made of magnetic material in said solenoid coil and spaced from said plunger by a gap, a magnetic responsive reed switch connected in series with said solenoid coil and disposed near the gap between said plunger and said plunger receiver, and a sensor terminal between said solenoid coil and said reed switch, said reed switch being positioned to close in response to a magnetic field generated when a current flows through said sensor terminal in said solenoid coil, said solenoid coil including two coils connected in series with each other through said reed switch, a pair of diodes having anodes and cathodes, said solenoid coil having ends connected to the anodes of said diodes, said diodes having the cathodes connected to each other and further connected to said sensor terminal.

2. An actuator with a built-in reed switch according to claim 1, wherein said actuator is a solenoid relay.

3. An actuator with a built-in reed switch according to claim 1, wherein said actuator is used as a relay for a power interrupter circuit which detects a current flowing by immersing said sensor terminal into the water to interrupt the power source.

* * * * *

UNITED STATES PATENT AND TRADEMARK OFFICE

CERTIFICATE OF CORRECTION

PATENT NO. : 5,113,308

DATED : May 12, 1992

INVENTOR(S) : HIDEAKI TAKEDA

It is certified that error appears in the above-identified patent and that said Letters Patent is hereby corrected as shown below:

ON THE TITLE PAGE

After "[22] Filed August 31, 1990", add the new lines

--[30] Foreign Priority Data

January 8, 1990 Japan 1207/1990--

Signed and Sealed this

Twenty-ninth Day of June, 1993

Attest:

Michael K. Kirk

MICHAEL K. KIRK

Attesting Officer

Acting Commissioner of Patents and Trademarks